US010784028B2

(12) United States Patent
Ishiyama et al.

(10) Patent No.: US 10,784,028 B2
(45) **Date of Patent: *Sep. 22, 2020**

(54) R-T-B BASED PERMANENT MAGNET

(71) Applicant: TDK CORPORATION, Tokyo (JP)

(72) Inventors: Tamotsu Ishiyama, Tokyo (JP); Masashi Miwa, Tokyo (JP); Takashi Watanabe, Tokyo (JP)

(73) Assignee: TDK CORPORATION, Tokyo (JP)

( * ) Notice: Subject to any disclaimer, the term of this patent is extended or adjusted under 35 U.S.C. 154(b) by 162 days.

This patent is subject to a terminal disclaimer.

(21) Appl. No.: 15/440,443

(22) Filed: Feb. 23, 2017

(65) Prior Publication Data

US 2017/0250013 A1 Aug. 31, 2017

(30) Foreign Application Priority Data

Feb. 26, 2016 (JP) ..... 2016-035105

(51) Int. Cl.
*H01F 41/02* (2006.01)
*H01F 1/057* (2006.01)
(Continued)

(52) U.S. Cl.
CPC ..... *H01F 1/053* (2013.01); *B22F 3/16* (2013.01); *B22F 5/00* (2013.01); *B22F 9/04* (2013.01); *C21D 3/06* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *B22F 1/0014* (2013.01); *B22F 2009/042* (2013.01); *B22F 2009/044* (2013.01); *B22F 2201/11* (2013.01); *B22F 2201/20* (2013.01);
(Continued)

(58) Field of Classification Search
None
See application file for complete search history.

(56) References Cited

U.S. PATENT DOCUMENTS

2011/0025440 A1 2/2011 Kuniyoshi et al.
2014/0105779 A1* 4/2014 Nakamura ..... H01F 1/0572 419/31
(Continued)

FOREIGN PATENT DOCUMENTS

CN 1065151 A 10/1992
CN 104395971 A 3/2015
(Continued)

*Primary Examiner* — Xiaowei Su
(74) *Attorney, Agent, or Firm* — Oliff PLC

(57) ABSTRACT

An R-T-B based permanent magnet includes main phase grains composed of $R_2T_{14}B$ type compound. R is a rare earth element. T is iron group element(s) essentially including Fe or Fe and Co. B is boron. An average grain size of the main phase grains is 0.8 μm to 2.8 μm. The R-T-B based permanent magnet contains at least C and Ga in addition to R, T, and B. B is contained at 0.71 mass % to 0.86 mass %. C is contained at 0.13 mass % to 0.34 mass %. Ga is contained at 0.40 mass % to 1.80 mass %. A formula (1) of $0.14 \leq [C]/([B]+[C]) \leq 0.30$ is satisfied, where [B] is a B content represented by atom %, and [C] is a C content represented by atom %.

16 Claims, 2 Drawing Sheets

(51) Int. Cl.

| | |
|---|---|
| ***B22F 3/10*** | (2006.01) |
| ***B22F 3/24*** | (2006.01) |
| ***H01F 1/053*** | (2006.01) |
| ***B22F 3/16*** | (2006.01) |
| ***B22F 5/00*** | (2006.01) |
| ***B22F 9/04*** | (2006.01) |
| ***C21D 3/06*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| *B22F 1/00* | (2006.01) |
| *H01F 1/058* | (2006.01) |

(52) U.S. Cl.

CPC ..... *B22F 2301/355* (2013.01); *B22F 2998/10* (2013.01); *B22F 2999/00* (2013.01); *C22C 2202/02* (2013.01); *H01F 1/058* (2013.01)

(56) References Cited

U.S. PATENT DOCUMENTS

| | | | | |
|---|---|---|---|---|
| 2014/0132377 | A1* | 5/2014 | Nakajima | B22F 3/24 335/302 |
| 2015/0170810 | A1* | 6/2015 | Miwa | C22C 38/001 75/246 |
| 2016/0027564 | A1* | 1/2016 | Une | B22F 1/0044 419/30 |
| 2016/0042847 | A1 | 2/2016 | Nishiuchi et al. | |
| 2017/0025207 | A1 | 1/2017 | Nakajima et al. | |
| 2017/0250015 | A1* | 8/2017 | Miwa | C22C 33/04 |

FOREIGN PATENT DOCUMENTS

| | | | | |
|---|---|---|---|---|
| EP | 0753867 | A1 | 1/1997 | |
| JP | 2013-216965 | A | 10/2013 | |
| WO | 2009/122709 | A1 | 10/2009 | |
| WO | WO-2013191276 | A1 * | 12/2013 | C22C 38/001 |
| WO | 2014/157448 | A1 | 10/2014 | |

* cited by examiner

R-T-B BASED PERMANENT MAGNET

BACKGROUND OF THE INVENTION

1. Field of the Invention

The present invention relates to an R-T-B based permanent magnet whose main components are a rare earth element (R), at least one or more kinds of iron element essentially including Fe or Fe and Co (T), and boron (B).

2. Description of the Related Art

R-T-B based permanent magnets have excellent magnetic properties and are thus used for home electric appliances, various kinds of motors such as voice coil motors (VCM) of hard disk drive and motors mounted on hybrid cars, and the like. When the R-T-B based permanent magnet is used for the motor or so, it is required to be excellent in heat resistance for responding to a use environment of high temperature and further have a high coercivity.

As a method for improving coercivity (HcJ) of the R-T-B based permanent magnet, the rare earth element R to which a light rare earth element of Nd, Pr etc. is mainly applied is partially substituted with a heavy rare earth element of Dy, Tb etc. in order to improve crystal magnetic anisotropy of $R_2T_{14}B$ phases. It tends to be hard to manufacture a magnet having coercivity large enough to be used for the motors without using the heavy rare earth element.

Dy and Tb, however, are more rare in yield and more expensive than Nd and Pr. In recent years, supply instability of Dy and Tb has been worsening due to rapidly expanding demand in R-T-B based permanent magnets of high coercivity type using a large amount of Dy and Tb. It is thus required to obtain coercivity needed for application to the motors or so even in case of a composition containing Dy and Tb as little as possible.

Under such circumstances, research and development for improving coercivity of R-T-B based permanent magnets without using Dy or Tb have been actively conducted. In the research and development, it is reported that coercivity is improved by a composition using less amount of B than an ordinary R-T-B based permanent magnet.

For example, Patent Document 1 reports that an R-T-B based sintered magnet using less amount of Dy and having a high coercivity is obtained by having a concentration of B lower than an ordinary R-T-B based alloy and containing one or more kinds of metal element "M" selected from Al, Ga, and Cu so as to generate an $R_2T_{17}$ phase, and by sufficiently securing a volume ratio of a transition metal rich phase ($R_6T_{13}M$) generated by using the $R_2T_{17}$ phase as raw material.

Patent Document 2 reports that an R-T-B based sintered magnet having a high Br and a high HcJ is obtained without using Dy by having a composition whose amount of R, amount of B, and amount of Ga are within specific ranges to form a thick two-grain boundary.

However, the R-T-B based sintered magnet obtained without using Dy or Tb by these techniques still have an insufficient coercivity as magnets used for the motors under high temperature environment.

Meanwhile, it is generally known that coercivity can be increased by miniaturizing main phase grains in the R-T-B based permanent magnet. For example, Patent Document 3 discloses a technique for improving coercivity of the R-T-B based sintered magnet by configuring a crystal grain size of main phases in the R-T-B based sintered magnet to a circle equivalent diameter of 8 μm or less and by configuring an area ratio occupied by crystal grains of 4 μm or less to 80% or more of the entire main phases. In the R-T-B based sintered magnet containing miniaturized main phase grains, however, a sufficient coercivity for using in high temperature environment still cannot be obtained in case of a composition failing to use Dy or Tb. Also, Patent Document 3 discloses a low sintering temperature of 1000° C. or lower so that sintering can be made without generating abnormal grain growth using a finely pulverized powder whose D50 is 3 μm or less, and thus has a problem of requiring a longtime sintering and decreasing productivity.

Patent Document 1: JP 2013-216965 A
Patent Document 2: WO 2014/157448
Patent Document 3: WO 2009/122709

SUMMARY OF THE INVENTION

The present inventors conceived that a further improvement of coercivity can be expected if the above-mentioned requirements are combined and the main phase grains of the R-T-B based permanent magnet can be miniaturized with a composition having a reduced amount of B, and then studied. The following problems, however, have become clear only if those techniques are simply combined.

When the main phase grains of the R-T-B based permanent magnet are miniaturized, a specific surface area of the main phase grains becomes large. Thus, the two-grain boundary entirely becomes thin, and partially becomes extremely thin. This causes magnetic separation of each main phase grain to be insufficient, and an R-T-B based permanent magnet having a high coercivity cannot be obtained. Then, the present inventors have considered increasing a content of a rare earth element that is a constituent for forming the grain boundary phases, but a multiple junction of the grain boundary (a grain boundary surrounded by three or more main phase grains) just becomes larger. Thus, the two-grain boundary fails to be thick, and coercivity is not improved.

The present invention has been achieved under the above circumstances. It is an object of the invention to provide an R-T-B based permanent magnet capable of obtaining a high coercivity even if a use amount of a heavy rare earth element is reduced.

To overcome the above problems and achieve the object, the present inventors have studied requirements for forming thick two-grain boundaries capable of a sufficient magnetic separation of each main phase grain even if the main phase grains of the R-T-B based permanent magnet have an average grain size of 2.8 μm or less. As a result, it was found out that a thickness of the two-grain boundary is largely affected by a balance between a B content and a C content in the main phase grains with a composition of a reduced B content. The present inventors have further studied and found out that a thick two-grain boundary can be formed by a specific balance between a B content and a C content with a composition of a specific range where a content of a rare earth element is increased and a content of B is decreased even in a case of the R-T-B based permanent magnet whose main phase grains have small grain sizes. Then, the present invention has been achieved.

The R-T-B based permanent magnet of the present invention is an R-T-B based permanent magnet including main phase grains composed of $R_2T_{14}B$ type compound, wherein R is a rare earth element, T is iron group element(s) essentially comprising Fe or Fe and Co, and B is boron, an average grain size of the main phase grains is 0.8 μm or more and 2.8 μm or less, the R-T-B based permanent magnet contains at least C and Ga in addition to R, T, and B, B is contained at 0.71 mass % or more and 0.86 mass % or less, C is contained at 0.13 mass % or more and 0.34 mass % or less, Ga is contained at 0.40 mass % or more and 1.80 mass % or less, and a formula (1) of $0.14 \leq [C]/([B]+[C]) \leq 0.30$ is satisfied, where [B] is a B content represented by atom %, and [C] is a C content represented by atom %.

The R-T-B based permanent magnet of the present invention makes it possible to obtain a high coercivity even with a composition of reduced contents of rare earth elements such as Dy and Tb due to combination between an improvement in coercivity by a composition of a reduced B content and an improvement in coercivity by miniaturization of the main phase grains.

The present inventors conceive as below the reason why a thick two-grain boundary and a high coercivity can be obtained only at the time of a specific balance between a B content and a C content.

(1) When a raw material having a composition where an amount of B is less than that of stoichiometric composition is used as a starting raw material, the amount of B for forming an $R_2T_{14}B$ type compound constituting the main phase grains is lacked. To make up for the shortage amount of B, C existing in the permanent magnet as an impurity is solid soluted into a B site of the $R_2T_{14}B$ type compound of the main phase grains, and the $R_2T_{14}B$ type compound represented by a composition formula of $R_2T_{14}B_xC_{(1-x)}$ is formed.

(2) When the permanent magnet is manufactured, a grain boundary phase changes to a liquid phase at the time of an aging treatment at around 500° C. In this step, an outermost surface portion of the main phase grains is partially dissolved and incorporated into the liquid phase. When the aging treatment is finished and the liquid phase changes to the solid phase once again by being cooled, the $R_2T_{14}B$ type compound is deposited once again on the surface of the main phase grains at the same time as the grain boundary phase of the solid phase is formed. The compound on the outermost surface of the main phase grains dissolved before the aging treatment is the compound represented by the composition formula of $R_2T_{14}B_xC_{(1-x)}$, but C is not solid soluted in the $R_2T_{14}B$ type compound in the temperature region of around 500° C., and the compound represented by the composition formula of $R_2T_{14}B$ is thus deposited on the outermost surface of the main phase grains when the liquid phase changes to the solid phase once again by being cooled. That is, the higher the ratio of $R_2T_{14}C$ contained in the $R_2T_{14}B_xC_{(1-x)}$ of the surface of the main phase grains before the aging treatment is, the more a volume of the main phase grains decreases and the more a volume of the grain boundary phases increases. According to such a mechanism, a thick two-grain boundary is formed by the aging treatment at around 500° C. Forming the thick two-grain boundary magnetically separates each of the main phase grains and expresses a high coercivity.

It is accordingly conceivable that setting a high ratio of $R_2T_{14}C$ in the main phase grains is important, and this makes it possible to form a thick two-grain boundary and obtain an R-T-B based permanent magnet having a high coercivity.

The R-T-B based permanent magnet according to the present invention may further include Zr, and a formula (2) of $5.2 \leq [B]+[C]-[Zr] \leq 5.4$ may be satisfied, where [B] is a B content represented by atom %, [C] is a C content represented by atom %, and [Zr] is a Zr content represented by atom %.

With a composition within such a range, it tends to become easier to obtain a higher coercivity.

The R-T-B based permanent magnet according to the present invention may further include Zr, and Zr may be contained at 0.4 mass % or more and 1.8 mass % or less.

The R-T-B based permanent magnet according to the present invention may further include Al, and Al may be contained at 0.03 mass % or more and 0.6 mass % or less.

In the R-T-B based permanent magnet according to the present invention, Co may be contained at 0.3 mass % or more and 4.0 mass % or less.

The R-T-B based permanent magnet according to the present invention may further include Cu, and Cu may be contained at 0.05 mass % or more and 1.5 mass % or less.

In the R-T-B based permanent magnet according to the present invention, a heavy rare earth element may not be substantially contained.

In the R-T-B based permanent magnet according to the present invention, C may be contained at 0.15 mass % or more and 0.34 mass % or less.

In the R-T-B based permanent magnet according to the present invention, C may be contained at 0.15 mass % or more and 0.30 mass % or less.

In the R-T-B based permanent magnet according to the present invention, B may be contained at 0.71 mass % or more and 0.81 mass % or less.

In the R-T-B based permanent magnet according to the present invention, Ga may be contained at 0.40 mass % or more and 1.40 mass % or less.

The present invention makes it possible to provide the R-T-B based permanent magnet capable of obtaining a high coercivity even if a use amount of a heavy rare earth element is reduced.

DESCRIPTION OF THE PREFERRED EMBODIMENTS

Hereinafter, the present invention will be described based on embodiments shown in the figures.

First Embodiment

The first embodiment of the present invention is directed to an R-T-B based sintered magnet that is a kind of R-T-B based permanent magnets.

<R-T-B Based Sintered Magnet>

Figure 1:
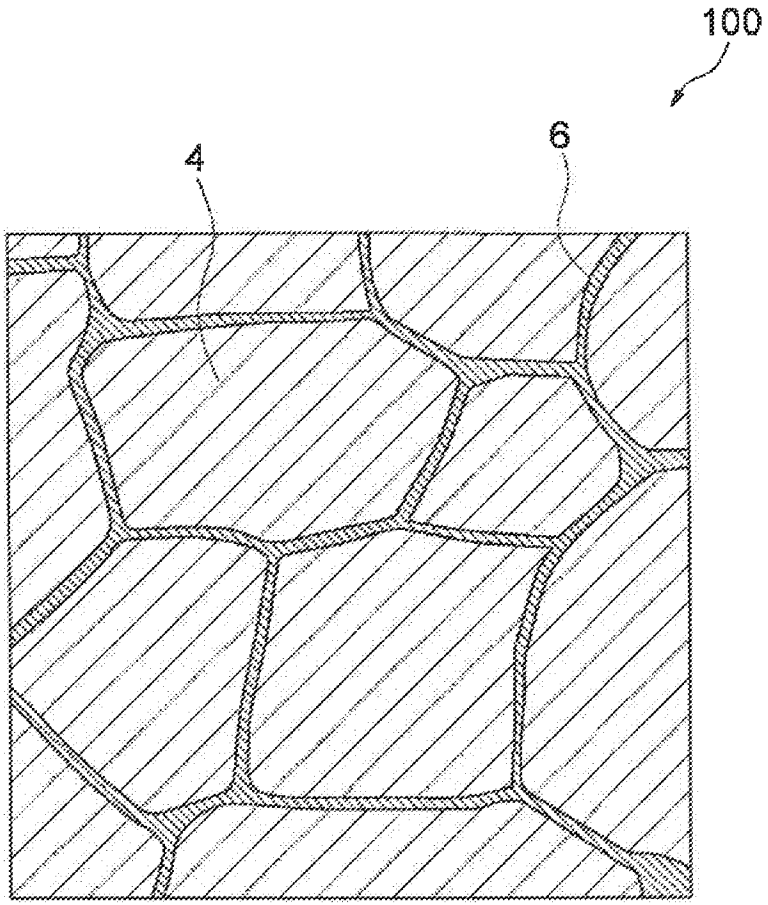
FIG. 1 is a schematic view showing a cross sectional structure of an R-T-B based sintered magnet according to an embodiment of the present invention.

An embodiment of the R-T-B based sintered magnet according to the first embodiment of the present invention will be described. As shown in FIG. 1, an R-T-B based sintered magnet 100 according to the present embodiment contains main phase grains 4 composed of $R_2T_{14}B$ type compound and grain boundaries 6 present among the main phase grains 4.

The main phase grains contained in the R-T-B based sintered magnet according to the present embodiment are composed of $R_2T_{14}B$ type compound having crystal structure of $R_2T_{14}B$ type tetragonal.

R represents at least one kind of rare earth elements. Rare earth elements are Sc, Y, and lanthanoid elements belonging to Group 3 in the long-periodic table. For example, lanthanoid elements include La, Ce, Pr, Nd, Sm, Eu, Gd, Tb, Dy, Ho, Er, Tm, Yb, Lu etc. Rare earth elements are divided into light rare earth elements and heavy rare earth elements. Heavy rare earth elements represent Gd, Tb, Dy, Ho, Er, Tm, Yb, and Lu, and light rare earth elements represent the other rare earth elements.

In the present embodiment, T represents one or more kinds of iron group element including Fe or Fe and Co. T may be only Fe, or may be Fe whose part is substituted with Co. When part of Fe is substituted with Co, temperature properties can be improved without deteriorating magnetic properties.

In the $R_2T_{14}B$ type compound according to the present embodiment, part of B can be substituted with C. This makes it easier to form thick two-grain boundaries during aging treatment and has an effect of easily improving coercivity.

The $R_2T_{14}B$ type compound constituting the main phase grains 4 according to the present embodiment may contain various known additive elements, specifically, may contain at least one kind of element of Ti, V, Cu, Cr, Mn, Ni, Zr, Nb, Mo, Hf, Ta, W, Al, Ga, Si, Bi, Sn, etc.

In the present embodiment, an average grain size of the main phase grains is obtained by analyzing a cross section of the R-T-B based sintered magnet using a means of image processing or so. Specifically, a cross sectional area of each main phase grain on the cross section of the R-T-B based sintered magnet is obtained by image analysis, and a diameter of a circle having this cross sectional area (circle equivalent diameter) is defined as a grain size of the main phase grain on the cross section. Furthermore, grain sizes with respect to all of the main phase grains present in a visual field subjected to analysis on the cross section are obtained, and an arithmetic average value represented by (a total of the grain sizes of the main phase grains)/(the number of the main phase grains) is defined as an average grain size of the respective main phase grains in the R-T-B based sintered magnet. Incidentally, in case of an anisotropy magnet, a cross section that is parallel to axes of easy magnetization of the R-T-B based sintered magnet is used for analysis.

The main phase grains contained in the R-T-B based sintered magnet according to the present embodiment has an average grain size of 2.8 μm or less. This makes it possible to obtain a high coercivity. Furthermore, the main phase grains may have an average grain size of 2.0 μm or less. This makes it easier to obtain a further high coercivity. The average grain size of the main phase grains has no lower limit, but may be 0.8 μm or more in view of favorably maintaining magnetization property of the R-T-B based sintered magnet.

The grain boundary phase of the R-T-B based sintered magnet according to the present embodiment has at least an R-rich phase whose concentration of R is higher than that of the $R_2T_{14}B$ type compound constituting the main phase grains, and may contain a B-rich phase whose concentration of boron (B) is high, an R oxide phase, an R carbide phase, a Zr compound phase, or the like, in addition to the R-rich phase.

In the R-T-B based sintered magnet according to the present embodiment, R may be contained at 29.5 mass % or more and 37.0 mass % or less, may be contained at 32.0 mass % or more and 36.0 mass % or less, or may be contained at 33.0 mass % or more and 36.0 mass % or less. When the main phase grains of the R-T-B based sintered magnet become fine, a specific surface area of the main phase grains becomes large. Thus, when R is contained at 32.0 mass % or more, a thick two-grain boundary tends to be easily formed, magnetic separation of the main phase grains becomes sufficient, and thereby coercivity tends to improve. When R is contained at 36.0 mass % or less, a ratio of the $R_2T_{14}B$ type compound contained in the R-T-B based sintered magnet increases, and thereby residual magnetic flux density tends to improve, abnormal grain growth during sintering becomes hard to occur, and coercivity becomes easier to improve. R may be contained at 33.0 mass % or more and 35.0 mass % or less in view of improving coercivity while maintaining residual magnetic flux density. In the present embodiment, the heavy rare earth element(s) contained as R may be contained at 1.0 mass % or less in view of cost reduction and resource risk avoidance. In the R-T-B based sintered magnet according to the present embodiment, a heavy rare earth element may not be substantially contained. What a heavy rare earth element is not substantially contained means that a heavy rare earth element is contained at 0.1 mass % or less.

In the R-T-B based sintered magnet according to the present embodiment, B is contained at 0.71 mass % or more and 0.86 mass % or less. B is a necessary component for the main phase grains, and is normally contained at stoichiometric composition of the $R_2T_{14}B$ type compound. In the present embodiment, however, B is contained in the range that is lower than stoichiometric composition of the $R_2T_{14}B$ type compound in this manner. Thus, thick two-grain boundaries are easily formed during aging treatment, and a high coercivity is easily obtained. When B is contained at less than 0.71 mass %, however, αFe becomes easy to remain, and this tends to decrease coercivity. B may be contained at 0.71 mass % or more and 0.81 mass % or less.

In the R-T-B based sintered magnet according to the present embodiment, C is contained at 0.13 mass % or more and 0.34 mass % or less. When C is contained at less than 0.13 mass %, a thick two-grain boundary cannot be obtained. There is a limit for the thickness of the two-grain boundary formed by increasing the content of C. Thus, when C is contained at more than 0.34 mass %, a further thicker two-grain boundary becomes hard to be formed, and coercivity is not improved any more. C may be contained at 0.15 mass % or more and 0.34 mass % or less, or may be contained at 0.15 mass % or more and 0.30 mass % or less. For example, the content of C in the sintered magnet can be adjusted by adjusting a content of C element in the raw material alloys or by adjusting an additive amount of organic component of a pulverization aid during a pulverization step, a pressing aid during a pressing step, and the like.

As described above, T is one or more kinds of iron element including Fe or Fe and Co. When Co is contained as T, Co may be contained at 0.3 mass % or more and 4.0 mass % or less, or may be contained at 0.5 mass % or more and 1.5 mass % or less. When Co is contained at 4.0 mass % or less, residual magnetic flux density tends to improve, and it tends to be easier to reduce cost of the R-T-B based sintered magnet according to the present embodiment. When Co is contained at 0.3 mass % or more, corrosion resistance tends to improve. The content of Fe in the R-T-B based sintered magnet according to the present embodiment is a substantial remaining part of constituent of the R-T-B based sintered magnet.

In the R-T-B based sintered magnet according to the present embodiment, Ga is contained at 0.40 mass % or more and 1.80 mass % or less. It becomes easy to form an $R_6T_{13}M$ type compound and a thick two-grain boundary and obtain a high coercivity by containing Ga with a composition of a small B content in which the $R_2T_{17}$ type compound generates easily. Thus, when Ga is contained at less than 0.40 mass %, a thick two-grain boundary is hard to be formed, and coercivity decreases. Furthermore, Ga may be contained at 0.60 mass % or more. This range can form a thicker two-grain boundary. Ga may be contained at 1.4 mass % or less in view of easily preventing decrease in residual magnetic flux density. Ga may be contained at 0.40 mass % or more and 1.4 mass % or less.

The R-T-B based sintered magnet according to the present embodiment may contain Cu. Cu may be contained at 0.05 mass % or more and 1.5 mass % or less, may be contained at 0.15 mass % or more and 0.60 mass % or less, or may be contained at 0.20 mass % or more and 0.40 mass % or less. Containing Cu makes it possible to have higher coercivity, higher corrosion resistance, and improved temperature properties of the magnet to be obtained. When Cu is contained at 1.5 mass % or less, residual magnetic flux density tends to improve. When Cu is contained at 0.05 mass % or more, coercivity tends to improve.

The R-T-B based sintered magnet according to the present embodiment may contain Al. Containing Al makes it possible to have higher coercivity, higher corrosion resistance, and improved temperature properties of the magnet to be obtained. Al may be contained at 0.03 mass % or more and 0.6 mass % or less, may be contained at 0.10 mass % or more and 0.4 mass % or less, or may be contained at 0.10 mass % or more and 0.3 mass % or less.

The R-T-B based sintered magnet according to the present embodiment may contain Zr at 0.4 mass % or more. With such a large amount of Zr, grain growth during sintering can be sufficiently prevented even if a finely pulverized powder has a small particle size. Zr may be contained at 0.6 mass % or more. This makes it possible to have a wide range of sintering temperature that can obtain a sufficient coercivity without causing abnormal grain growth. Zr may be contained at 2.5 mass % or less in view of easy prevention of decrease in residual magnetic flux density. Zr may be contained at 1.8 mass % or less, may be contained at 0.4 mass % or more and 2.5 mass % or less, or may be contained at 0.4 mass % or more and 1.8 mass % or less.

The R-T-B based sintered magnet of the present embodiment may contain an additive element other than the above elements, such as Ti, V, Cr, Mn, Ni, Nb, Mo, Hf, Ta, W, Si, Bi, and Sn. This additive element may be contained at 2.0 mass % or less in total provided that the entire R-T-B based sintered magnet is 100 mass %.

The R-T-B based sintered magnet according to the present embodiment may contain oxygen (O) at about 0.5 mass % or less. Oxygen may be contained at 0.05 mass % or more in view of corrosion resistance, or may be 0.2 mass % or less in view of magnetic properties.

The R-T-B based sintered magnet according to the present embodiment may contain a certain amount of nitrogen (N). This certain amount changes by other parameters or so and is appropriately determined, but nitrogen may be contained at 0.01 mass % or more and 0.2 mass % or less in view of magnetic properties.

In the R-T-B based sintered magnet according to the present embodiment, contents of each element are in the above-mentioned ranges, and contents of B and C satisfy the following specific relation. That is, a relation of $0.14 \leq [C]/([B]+[C]) \leq 0.30$ is satisfied, where [B] and [C] respectively represent a content of B and C by atom %. It becomes possible to form a thick two-grain boundary and obtain a high coercivity by adjusting a composition in such a range. Thus, a thick two-grain boundary is hard to be formed when [C]/([B]+[C]) is less than 0.14. When [C]/([B]+[C]) is more than 0.30, αFe becomes easy to remain, and this tends to decrease coercivity.

In the R-T-B based sintered magnet according to the present embodiment, the contents of each element may be adjusted by satisfying a formula (2) of $5.2 \leq [B]+[C]-[Zr] \leq 5.4$, where [B] is a B content represented by atom %, [C] is a C content represented by atom %, and [Zr] is a Zr content represented by atom %.

When [B]+[C]−[Zr] is 5.2 or more, a soft magnetic compound such as $R_2T_{17}$ type compound is hard to occur, and coercivity is easily improved. When [B]+[C]−[Zr] is 5.4 or less, a thick two-grain boundary is easily formed, and coercivity tends to improve.

The contents of each element in the R-T-B based sintered magnet can be measured by a generally known method, such as X-ray fluorescent analysis (XRF) and inductively coupled plasma emission spectroscopic analysis (ICP-AES). A content of C is measured by combustion in an oxygen airflow-infrared absorption method, for example.

In the present embodiment, the contents of B, C, and Zr represented by atom % are obtained by the following procedures.

(1) First, contents of each element contained in the R-T-B based sintered magnet are analyzed by the above-mentioned analysis methods to obtain analysis values (X1) by mass % of the contents of each element. Elements to be analyzed are C and elements contained in the R-T-B based sintered magnet at 0.05 mass % or more.

(2) The analysis values (X1) by mass % of the contents of each element are divided by atomic weights of each element to obtain values (X3).

(3) Ratios of the values (X3) of each element with respect to a total value of the values (X3) of all of the analyzed elements represented by percentage are calculated and defined as contents (X2) of each element represented by atom %.

The R-T-B based sintered magnet according to the present embodiment is generally machined into any shape and used. The R-T-B based sintered magnet according to the present embodiment has any shape, such as rectangular parallelepiped shape, hexahedron, flat plate, and square pillar. The R-T-B based sintered magnet according to the present embodiment may have any cross sectional shape, such as C shaped cylindrical shape. The square pillar may be one whose bottom surface is rectangular or square, for example.

The R-T-B based sintered magnet according to the present embodiment includes both magnet products that are magnetized after machining the magnet and magnet products in which the magnet is not magnetized.

<Method for Manufacturing R-T-B Based Sintered Magnet>

Figure 2:
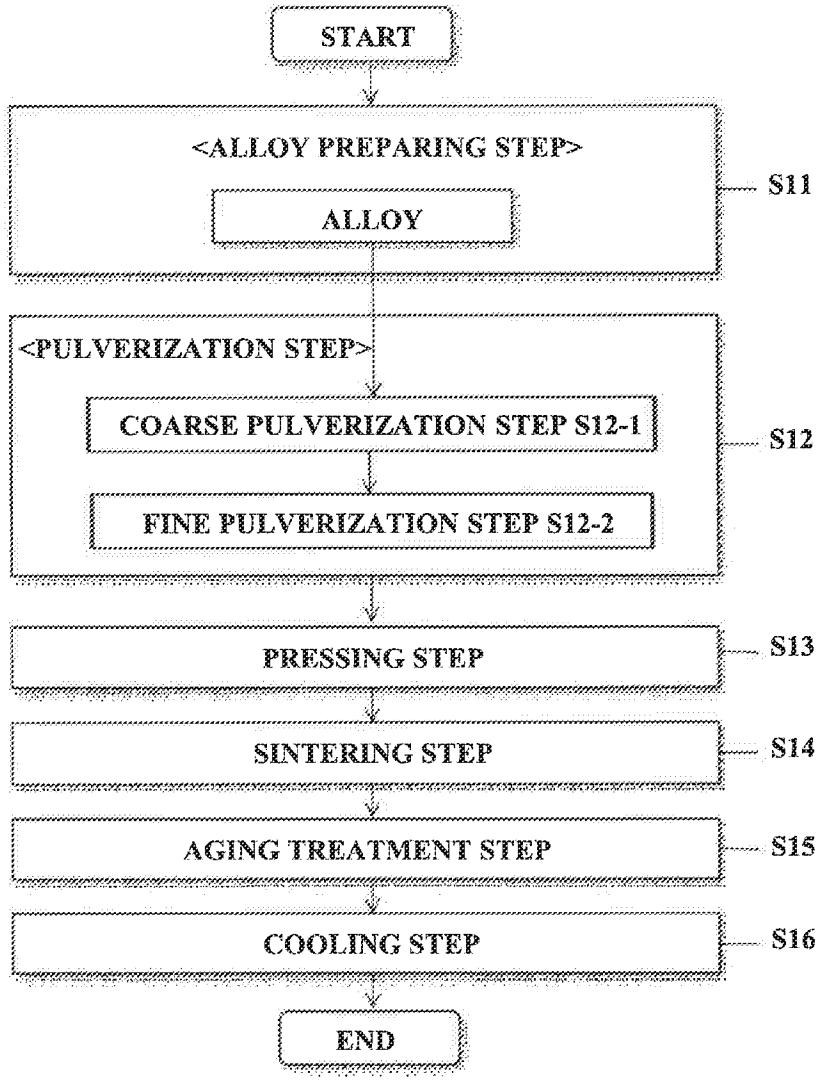
FIG. 2 is a flowchart showing a method for manufacturing an R-T-B based sintered magnet according to an embodiment of the present invention.

The figure is used to describe a method for manufacturing the R-T-B based sintered magnet according to the present embodiment having the above-mentioned structure. FIG. 2 is a flowchart showing a method for manufacturing an R-T-B based sintered magnet according to an embodiment of the present invention. As shown in FIG. 2, the method for manufacturing the R-T-B based sintered magnet according to the present embodiment has the following steps.

(a) Alloy preparing step for preparing a raw material alloy (Step S11)

(b) Pulverization step for pulverizing the raw material alloy (Step S12)

(c) Pressing step for pressing the pulverized raw material powder (Step S13)

(d) Sintering step for sintering a green compact to obtain an R-T-B based sintered magnet (Step S14)

(e) Aging treatment step for performing an aging treatment to the R-T-B based sintered magnet (Step S15)

(f) Cooling step for cooling the R-T-B based sintered magnet (Step S16)

[Alloy Preparing Step: Step S11]

A raw material alloy of the R-T-B based sintered magnet according to the present embodiment is prepared (alloy preparing step (Step S11)). In the alloy preparing step, raw material metals corresponding to the composition of the R-T-B based sintered magnet according to the present embodiment are melted in a vacuum or in an inert gas atmosphere of Ar gas or so, and are subjected to casting so as to prepare a raw material alloy having a desired composition. Incidentally, a one-alloy method using a single alloy as a raw material alloy is described in the present embodiment, but a two-alloy method that prepares a raw material powder by mixing two kinds of alloys of a first alloy and a second alloy may be employed.

As the raw material metals, for example, rare earth metals, rare earth alloys, pure iron, ferroboron, alloy or compound of these, or the like can be used. The raw material metals are casted by ingot casting method, strip casting method, book molding method, centrifugal casting method, or the like. The obtained raw material alloy is subjected to a homogenization treatment as necessary in the presence of solidification segregation. The homogenization treatment of the raw material alloy is conducted in a vacuum or an inert gas atmosphere at a temperature of 700° C. to 1500° C. for 1 hour or longer. The alloy for the R-T-B based sintered magnet is melted and homogenized by this treatment.

[Pulverization Step: Step S12]

After the raw material alloy is prepared, this raw material alloy is pulverized (pulverization step: Step S12). The pulverization step includes a coarse pulverization step (Step S12-1) for pulverizing the raw material alloy until particle sizes become about hundreds μm to several mm and a fine pulverization step (Step S12-2) for finely pulverizing the raw material alloy until particle sizes become about several μm.

(Coarse Pulverization Step: Step S12-1)

The raw material alloy is coarsely pulverized until particle sizes respectively become about hundreds μm to several mm (coarse pulverization step (Step S12-1)). This obtains a coarsely pulverized powder of the raw material alloy. The coarse pulverization can be carried out by causing a self-collapsed pulverization in such manner that hydrogen is stored in the raw material alloy, and that hydrogen is released based on differences in the storage amount of hydrogen among different phases to perform dehydrogenation (hydrogen storage pulverization).

Incidentally, the coarse pulverization step (Step S12-1) may be carried out using a coarse pulverization machine, such as stamp mill, jaw crusher, and brown mill, in an inert gas atmosphere except for using the above-mentioned hydrogen storage pulverization.

The atmosphere in each step from the pulverization step (Step S12) to the sintering step (Step S15) may be a low oxygen concentration to obtain high magnetic properties. The oxygen concentration is adjusted by controlling the atmosphere in each manufacturing step or so. When the oxygen concentration in each manufacturing step is high, the rare earth elements in the raw material alloy powder are oxidized, and the oxygen amount of the R-T-B based sintered magnet is increased to cause decrease in coercivity of the R-T-B based sintered magnet. Thus, the oxygen concentration in each step may be 100 ppm or less, for example.

(Fine Pulverization Step: Step S12-2)

After the raw material alloy is coarsely pulverized, the coarsely pulverized powder of the obtained raw material alloy is finely pulverized until an average particle size becomes about several μm (fine pulverization step (Step S12-2)). This obtains a finely pulverized powder of the raw material alloy. The coarsely pulverized powder is further finely pulverized to obtain a finely pulverized powder having particles whose average particle size is preferably 0.1 μm or more and 2.8 μm or less, more preferably 0.5 μm or more and 2.0 μm or less. The finely pulverized powder is configured to have such an average particle size, and thus the main phase grains after sintering can have an average grain size of 2.8 μm or less.

The fine pulverization is carried out by further pulverizing the coarsely pulverized powder using a fine pulverization machine, such as jet mil and bead mill, while conditions of pulverization time or so are appropriately adjusted. A jet mill is a dry pulverization method by releasing a high pressure inert gas (e.g. $N_2$ gas) from a narrow nozzle to generate a high speed gas flow and accelerating the coarsely pulverized powder of the raw material alloy using this high speed gas flow to cause collision among the coarsely pulverized powder of the raw material alloy and collision with a target or a container wall.

In particular, when a finely pulverized powder having a small particle size is obtained using a jet mill, the surface of the pulverized powder is very active, which easily generates reaggregation of the pulverized powder and adhesion thereof to a container wall and tends to have a low yield. Thus, when the coarsely pulverized powder of the raw material alloy is finely pulverized, a finely pulverized powder can be obtained at a high yield by adding a pulverization aid of zinc stearate, oleic amide, or the like to prevent reaggregation of the powder and adhesion thereof to a container wall. A finely pulverized powder that can be oriented easily during pressing can be obtained by adding a pulverization aid. An addition amount of a pulverization aid changes based on a particle size of the finely pulverized powder and a kind of the pulverization aid to be added, but may be about 0.1% or more and 1% or less by mass %.

There is a wet pulverization method other than a dry pulverization method like a jet mill. A bead mill for performing a high speed stirring using a small diameter bead can be employed as the wet pulverization method. A multiple pulverization for conducting a dry pulverization using a jet mill and further conducting a wet pulverization using a bead mill may be carried out.

[Pressing Step: Step S13]

After the raw material alloy is finely pulverized, the finely pulverized powder is pressed into a desired shape (pressing step (Step S13)). In the pressing step (Step S13), the finely pulverized powder is filled in a press mold arranged in an electromagnet and is pressed into any shape. This operation is carried out while a magnetic field is applied to generate a predetermined orientation of the finely pulverized powder and orient crystal axis. This obtains a green compact. A green compact to be obtained is oriented in a specific direction, and thus an R-T-B based sintered magnet having anisotropy with stronger magnetism is obtained.

The finely pulverized powder may be pressed at 30 MPa to 300 MPa. The magnetic field to be applied may be at 950 kA/m to 1600 kA/m. The magnetic field to be applied is not limited to a static magnetic field, and may be a pulsed magnetic field. A static magnetic field and a pulsed magnetic field may be used at the same time as the magnetic field to be applied.

Incidentally, a wet pressing for pressing a slurry where the finely pulverized powder is dispersed in a solvent of oil or so can be applied to the pressing method other than a dry pressing for pressing the finely pulverized powder as it is as described above.

The green compact obtained by pressing the finely pulverized powder has any shape, such as parallel piped shape, flat plate shape, column shape, and ring shape, based on a desired shape of the R-T-B based sintered magnet.

[Sintering Step: Step S14]

The green compact obtained by being pressed in a magnetic field and pressing into a desired shape is sintered in a vacuum or an inert gas atmosphere to obtain the R-T-B based sintered magnet (sintering step (Step S14)). The green compact is sintered by being heated in a vacuum or in the presence of an inert gas at 900° C. to 1200° C. for 1 hour to 72 hours, for example. This causes the finely pulverized powder to have liquid phase sintering, and an R-T-B based sintered magnet (a sintered body of an R-T-B based magnet) whose main phase grains have an improved volume ratio is obtained. In order that the main phase grains have an average grain size of 2.8 μm or less, sintering temperature and sintering time need to be adjusted based on conditions of composition, pulverization method, difference between particle size and particle size distribution, and the like.

After the green compact is sintered, the sintered body may be rapidly cooled in view of improving manufacturing efficiency.

[Aging Treatment Step: Step S15]

After the green compact is sintered, the R-T-B based sintered magnet is subjected to an aging treatment (aging treatment step (Step S15)). After the sintering, the R-T-B based sintered magnet is subjected to an aging treatment by being held at a temperature that is lower than the temperature during the sintering. The aging treatment can be carried out by conducting a heating treatment in a vacuum or in the presence of an inert gas at 400° C. to 900° C. for 10 minutes to 10 hours, for example. If necessary, the aging treatment may be carried out multiple times at different temperatures. Such an aging treatment can improve magnetic properties of the R-T-B based sintered magnet. In the R-T-B based sintered magnet of the present embodiment, a temperature at the time of the aging treatment may be in a range of 400° C. to 600° C. Aging treatment temperature and aging treatment time are appropriately adjusted in this temperature range based on conditions of composition, difference between grain size and grain size distribution, and the like. This makes it possible to form thick two-grain boundaries and thus obtain a high coercivity.

[Cooling Step: Step S16]

After the R-T-B based sintered magnet is subjected to the aging treatment, the R-T-B based sintered magnet is rapidly cooled in an Ar gas atmosphere (cooling step (Step S16)). Then, the R-T-B based sintered magnet according to the present embodiment can be obtained. To form thick two-grain boundaries and obtain a high coercivity, a cooling rate may be 30° C./min or more.

The R-T-B based sintered magnet obtained through the above steps may be machined into a desired shape as necessary. This machining method may be a shaping process, such as cutting and grinding, a chamfering process, such as barrel polishing, or the like.

There may be a step for further diffusing heavy rare earth elements to the grain boundaries of the machined R-T-B based sintered magnet. This grain boundary diffusion can be carried out by performing a heat treatment after a compound containing heavy rare earth elements is adhered on the surface of the R-T-B based sintered magnet by application, vapor deposition, or the like, or by performing a heat treatment against the R-T-B based sintered magnet in an atmosphere containing a vapor of heavy rare earth elements. This makes it possible to further improve coercivity of the R-T-B based sintered magnet.

The obtained R-T-B based sintered magnet may be subjected to a surface treatment, such as plating, resin coating, oxidation treatment, and chemical conversion treatment. This makes it possible to further improve corrosion resistance.

The R-T-B based sintered magnet according to the present embodiment is preferably used as a magnet of, for example, a surface magnet type (Surface Permanent Magnet: SPM) motor where a magnet is attached on the surface of a rotor, an interior magnet embedded type (Interior Permanent Magnet: IPM) motor such as inner rotor type brushless motor, and a Permanent Magnet Reluctance Motor (PRM). Specifically, the R-T-B based sintered magnet according to the present embodiment is preferably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a magnet generator and the like.

Second Embodiment

The second embodiment of the present invention is directed to an R-T-B based permanent magnet manufactured by hot working. Matters of the second embodiment that are not described below are identical to those of the first embodiment. The term of "sintering" in the first embodiment shall be replaced as necessary.

<Method for Manufacturing R-T-B Based Permanent Magnet by Hot Working>

The method for manufacturing the R-T-B based permanent magnet according to the present embodiment has the following steps.

(a) Melt rapid cooling step for melting a raw material metal and rapidly cooling an obtained molten metal to obtain a ribbon (b) Pulverization step for pulverizing the ribbon to obtain a flaky raw material powder (c) Cold forming step for performing cold forming to the pulverized raw material powder (d) Preliminary heating step for preliminarily heating the cold-formed body (e) Hot forming step for performing hot forming to the preliminarily heated cold-formed body (f) Hot plastic working step for plastically deforming the hot-formed body into a predetermined shape (g) Aging treatment step for performing an aging treatment to the R-T-B based permanent magnet (a) The melt rapid cooling step is a step for melting a raw material metal and rapidly cooling an obtained molten metal to obtain a ribbon. The raw material metal is melted by any method as long as a molten metal whose component is uniform and fluidity is capable of rapid cooling solidification is obtained. The temperature of the molten metal is not limited, but may be 1000° C. or higher.

Next, the molten metal is rapidly cooled to obtain a ribbon. Specifically, the ribbon is obtained by dropping the molten metal to a rotary roll. A cooling rate of the molten metal can be adjusted by controlling a rotating speed of the rotary roll and a drop amount of the molten metal. The rotating speed is normally 10 to 30 m/sec.

(b) The pulverization step is a step for pulverizing the ribbon obtained in the melt rapid cooling step (a). There is no limit for the pulverization method. The pulverization obtains a flaky alloy powder composed of fine crystal grains of about 20 nm.

(c) The cold forming step is a step for performing cold forming to the flaky raw material powder obtained in the pulverization step (b). The cold forming is carried out by filling the raw material powder into a mold and then pressing this at a room temperature. The pressing is carried out at any pressure. The higher the pressure is, the higher the density of a cold-formed body to be obtained becomes. The density is, however, saturated if the pressure becomes a certain value or higher. Thus, no effect is demonstrated if pressure is added more than necessary. The pressing pressure is appropriately selected based on composition, particle size, and the like of the alloy powder.

There is no limit for the pressing time either. The longer the pressing time is, the higher the density of a cold-formed body to be obtained becomes. The density is, however, saturated if the pressing time becomes a certain value or longer. The density is normally saturated when the pressing time is 1 to 5 seconds.

(d) The preliminary heating step is a step for preliminarily heating the cold-formed body obtained in the cold forming step (c). The preliminary heating temperature is not limited, but is normally 500° C. or higher and 850° C. or lower. Conditions of the preliminary heating are optimized to obtain a formed body whose crystal structure is uniform and fine in the hot forming step (e) and to further improve a magnetic orientation degree in the hot plastic working step (f).

When the preliminary heating temperature is 500° C. or higher, grain boundary phases can be sufficiently liquefied in the hot forming step, and cracks of the formed body become hard to occur during the hot forming. The preliminary heating temperature may be 600° C. or higher, or may be 700° C. or higher. In contrast, when the preliminary heating temperature is 850° C. or lower, it becomes easier to prevent crystal grains from being coarse and to further prevent oxidation of magnetic materials. The preliminary heating temperature may be 800° C. or lower, or may be 780° C. or lower.

The preliminary heating time is a time where the cold-formed body reaches a certain temperature. The preliminary heating time is appropriately controlled to sufficiently liquefy grain boundary phases in the hot forming step, to prevent cracks of the formed body from occurring during the hot forming, and to make it easier to prevent crystal grains from being coarse. The preliminary heating time may be appropriately selected based on size of the formed body, the preliminary heating temperature, and the like. In general, the larger the size of the formed body becomes, the longer a preferable preliminary heating time becomes. Also, the lower the preliminary heating temperature becomes, the longer a preferable preliminary heating time becomes. The atmosphere during the preliminary heating is not limited, but may be an inert atmosphere or a reducing atmosphere in view of preventing oxidation of magnetic materials and decrease in magnetic properties.

(e) The hot forming step is a step for performing hot pressing to the preliminarily heated cold-formed body obtained in the preliminary heating step (d). The hot forming step can densify magnet materials.

The term of "hot forming" is a so-called hot pressing method. When the cold-formed body is hotly pressed using a hot pressing method, pores remaining in the cold-formed body disappear to achieve densification of the cold-formed body.

The hot forming using a hot pressing method is carried out by any method, such as a method for preliminarily heating the cold-formed body, inserting the preliminarily heated cold-formed body into a mold that is heated to a predetermined temperature, and pressing the cold-formed body at a predetermined pressure for a predetermined time. Hereinafter, the hot forming by this method will be described.

Conditions of the hot pressing are optimally selected based on composition, required properties, and the like. In general, when the hot pressing temperature is 750° C. or higher, grain boundary phases can be sufficiently liquefied, the formed body is sufficiently densified, and cracks of the formed body become hard to occur. In contrast, when the hot pressing temperature is 850° C. or lower, it becomes easier to prevent crystal grains from being coarse, and magnetic properties can be consequently improved.

The hot pressing is carried out at any pressure. The higher the pressure is, the higher the density of a hot-formed body to be obtained becomes. The density is, however, saturated if the pressure becomes a certain value or higher. Thus, no effect is demonstrated if pressure is added more than necessary. The hot pressing pressure is appropriately selected based on composition, particle size, and the like of the alloy powder.

The hot pressing time is not limited either. The longer the hot pressing time is, the higher the density of a hot-formed body to be obtained becomes. Crystal grains may, however, be coarse if the hot pressing time is longer more than necessary. The hot pressing time is appropriately selected based on composition, particle size, and the like of the alloy powder.

The atmosphere during the hot pressing is not limited, but may be an inert atmosphere or a reducing atmosphere in view of preventing oxidation of magnetic materials and decrease in magnetic properties.

(f) The hot plastic working step is a step for obtaining a magnet material by plastically deforming the hot-formed body obtained in the hot forming step (e) into a predetermined shape. The hot plastic working step is carried out by any method, but is particularly preferably carried out by a method of hot extrusion in view of productivity.

The working temperature is not limited. In general, when the working temperature is 750° C. or higher, grain boundary phases are sufficiently liquefied, the formed body is sufficiently densified, and cracks of the formed body become hard to occur. In contrast, when the working temperature is 850° C. or lower, it becomes easier to prevent crystal grains from being coarse, and magnetic properties can be consequently improved. An R-T-B based permanent magnet having desired composition and shape is obtained by carrying out a post machining as necessary after the hot plastic working step.

(g) The aging treatment step is a step for performing an aging treatment to the R-T-B based permanent magnet obtained in the hot plastic working step (f). The aging treatment is performed to the R-T-B based permanent magnet by holding the obtained the R-T-B based permanent magnet at a temperature that is lower than the temperature during the hot plastic working step after the hot plastic working, for example. The aging treatment can be carried out by performing a heating treatment in a vacuum or in the presence of an inert gas at 400° C. to 700° C. for 10 minutes to 10 hours, for example. The aging treatment may be carried out multiple times by changing the temperature as necessary. Such an aging treatment can improve magnetic properties of the R-T-B based permanent magnet. In the R-T-B based permanent magnet of the present embodiment, the temperature during the aging treatment is particularly preferably in a range of 400° C. to 600° C. In this temperature range, aging treatment temperature and aging treatment time are appropriately adjusted based on conditions, such as composition and difference between grain size and grain size distribution. This makes it possible to form thick two-grain boundaries and thus obtain a high coercivity.

Hereinafter, a mechanism how an R-T-B based permanent magnet having magnetic anisotropy can be obtained by the hot-forming step and the hot plastic working step will be described.

The inside of the hot-formed body consists of crystal grains and grain boundary phases. The grain boundary phases begin to liquefy when the formed body becomes high temperature during the hot forming. Then, when the heating temperature becomes higher, the crystal grains are surrounded by the liquefied grain boundary phases. Then, the crystal grains become possible to rotate. In this stage, however, the directions of axes of easy magnetization, that is, the directions of magnetization are nonuniform (equalization state). That is, the hot-formed body has normally no magnetic anisotropy.

Next, the obtained hot-formed body is subjected to the hot plastic working to be plastically deformed and obtain a magnet material having a desired shape. At this time, the crystal grains are compressed in a pressurizing direction and plastically deformed, and the axes of easy magnetization are oriented in the pressurizing direction at the same time. Thus, an R-T-B based permanent magnet having magnetic anisotropy is obtained.

Incidentally, the present invention is not limited to the above embodiments, but can be variously changed within the scope thereof.

EXAMPLES

Hereinafter, the invention will be described in more detail based on the examples, but is not limited thereto.

Experimental Examples 1 to 10

First, raw materials of elements other than C were weighed so that R-T-B based sintered magnets having compositions of Experimental Examples 1 to 10 shown in Table 1 were respectively obtained, melted, and casted by a strip casing method. Then, flaky raw material alloys whose compositions corresponded to each of Experimental Examples were obtained.

Next, a hydrogen pulverization treatment (coarse pulverization) for respectively storing hydrogen in these raw material alloys at room temperatures and respectively performing dehydrogenation at 400° C. for 1 hour in an Ar atmosphere was carried out.

Incidentally, in the present examples, each step from this hydrogen pulverization treatment to sintering (fine pulverization and pressing) was carried out in an Ar atmosphere having an oxygen concentration of less than 50 ppm.

Next, an oleic amide of 0.07 mass % as a pulverization aid was added to the respective coarsely pulverized powders subjected to the hydrogen pulverization treatment, and a fine pulverization was subsequently performed thereto using a jet mill. In the fine pulverization, a particle size of the finely pulverized powder was adjusted so that the main phase grains of the R-T-B based sintered magnet had an average grain size of 1.7 μm by adjusting a classification condition of the jet mill.

Thereafter, the amounts of C contained each of the finely pulverized powders thus obtained were measured by a combustion in an oxygen airflow-infrared absorption method. Then, the respectively finely pulverized powders were mixed with a predetermined amount of carbon black. This was because a C content finally contained in the sintered magnet was adjusted.

The obtained mixed powder was filled in a press mold arranged in an electromagnet and pressed at 120 MPa while a magnetic field of 1200 kA/m was applied, whereby a green compact was obtained.

Thereafter, the obtained green compact was sintered. In this sintering, the green compact was held in a vacuum at 1030° C. for 12 hours and rapidly cooled, whereby a sintered body (R-T-B based sintered magnet) was obtained. Then, the obtained sintered body was subjected to a two-step aging treatment performed at 850° C. for 1 hour and performed at 500° C. for 1 hour (both of which were in an Ar atmosphere), whereby R-T-B sintered magnets of Experimental Examples 1 to 10 were respectively obtained.

TABLE 1

| | | Sintered magnet composition | | | | | | | | | | |
|---|---|---|---|---|---|---|---|---|---|---|---|---|
| | | Nd | Pr | Dy | Tb | T.RE | Fe | Co | B | C | Ga | Al |
| Experimental | mass % | 27.0 | 6.0 | 0.0 | 0.0 | 33.0 | 63.3 | 0.50 | 0.96 | 0.05 | 0.60 | 0.20 |
| Ex. 1 | atom % | 12.5 | 2.8 | 0.0 | 0.0 | 15.3 | 75.7 | 0.57 | 5.93 | 0.28 | 0.57 | 0.50 |
| Experimental | mass % | 27.0 | 6.0 | 0.0 | 0.0 | 33.0 | 63.3 | 0.50 | 0.91 | 0.10 | 0.60 | 0.20 |
| Ex. 2 | atom % | 12.5 | 2.8 | 0.0 | 0.0 | 15.4 | 75.7 | 0.57 | 5.62 | 0.56 | 0.57 | 0.50 |
| Experimental | mass % | 27.0 | 6.0 | 0.0 | 0.0 | 33.0 | 63.3 | 0.50 | 0.86 | 0.15 | 0.60 | 0.20 |
| Ex. 3 | atom % | 12.5 | 2.8 | 0.0 | 0.0 | 15.4 | 75.7 | 0.57 | 5.32 | 0.83 | 0.58 | 0.50 |
| Experimental | mass % | 27.0 | 6.0 | 0.0 | 0.0 | 33.0 | 63.3 | 0.50 | 0.81 | 0.20 | 0.60 | 0.20 |
| Ex. 4 | atom % | 12.5 | 2.8 | 0.0 | 0.0 | 15.4 | 75.8 | 0.57 | 5.01 | 1.11 | 0.58 | 0.50 |
| Experimental | mass % | 27.0 | 6.0 | 0.0 | 0.0 | 33.0 | 63.3 | 0.50 | 0.76 | 0.25 | 0.60 | 0.20 |
| Ex. 5 | atom % | 12.5 | 2.8 | 0.0 | 0.0 | 15.4 | 75.8 | 0.57 | 4.70 | 1.39 | 0.58 | 0.50 |
| Experimental | mass % | 27.0 | 6.0 | 0.0 | 0.0 | 33.0 | 63.3 | 0.50 | 0.71 | 0.30 | 0.60 | 0.20 |
| Ex. 6 | atom % | 12.5 | 2.8 | 0.0 | 0.0 | 15.4 | 75.8 | 0.57 | 4.39 | 1.67 | 0.58 | 0.50 |
| Experimental | mass % | 27.0 | 6.0 | 0.0 | 0.0 | 33.0 | 63.3 | 0.50 | 0.66 | 0.35 | 0.60 | 0.20 |
| Ex. 7 | atom % | 12.5 | 2.8 | 0.0 | 0.0 | 15.4 | 75.8 | 0.57 | 4.08 | 1.95 | 0.58 | 0.50 |
| Experimental | mass % | 27.0 | 5.5 | 0.5 | 0.0 | 33.0 | 63.5 | 0.50 | 0.75 | 0.24 | 0.60 | 0.20 |
| Ex. 8 | atom % | 12.5 | 2.6 | 0.2 | 0.0 | 15.3 | 76.0 | 0.57 | 4.64 | 1.34 | 0.58 | 0.50 |

TABLE 1-continued

| | | | | | | | | | | | |
|---|---|---|---|---|---|---|---|---|---|---|---|
| Experimental Ex. 9 | mass % | 27.0 | 5.5 | 0.0 | 0.5 | 33.0 | 63.5 | 0.50 | 0.75 | 0.24 | 0.60 | 0.20 |
| | atom % | 12.5 | 2.6 | 0.0 | 0.2 | 15.3 | 76.0 | 0.57 | 4.64 | 1.34 | 0.58 | 0.50 |
| Experimental Ex. 10 | mass % | 32.4 | 0.0 | 0.3 | 0.3 | 33.0 | 63.4 | 0.50 | 0.75 | 0.26 | 0.60 | 0.20 |
| | atom % | 15.0 | 0.0 | 0.1 | 0.1 | 15.3 | 76.0 | 0.57 | 4.64 | 1.45 | 0.58 | 0.50 |

| | | Sintered magnet composition | | | | Average grain size | Br | Hcj | |
|---|---|---|---|---|---|---|---|---|---|
| | | Cu | Zr | total | [C]/([B] + [C]) | (μm) | kG | kOe | |
| Experimental Ex. 1 | mass % | 0.30 | 1.10 | 100 | 0.04 | 1.7 | 13.7 | 18.7 | Comp. |
| | atom % | 0.32 | 0.81 | 100 | | | | | Ex. |
| Experimental Ex. 2 | mass % | 0.30 | 1.10 | 100 | 0.09 | 1.7 | 13.6 | 19.5 | Comp. |
| | atom % | 0.32 | 0.81 | 100 | | | | | Ex. |
| Experimental Ex. 3 | mass % | 0.30 | 1.10 | 100 | 0.14 | 1.7 | 13.4 | 22.6 | Ex. |
| | atom % | 0.32 | 0.81 | 100 | | | | | |
| Experimental Ex. 4 | mass % | 0.30 | 1.10 | 100 | 0.18 | 1.7 | 13.2 | 23.3 | Ex. |
| | atom % | 0.32 | 0.81 | 100 | | | | | |
| Experimental Ex. 5 | mass % | 0.30 | 1.10 | 100 | 0.23 | 1.7 | 13.0 | 24.0 | Ex. |
| | atom % | 0.32 | 0.81 | 100 | | | | | |
| Experimental Ex. 6 | mass % | 0.30 | 1.10 | 100 | 0.28 | 1.7 | 12.7 | 24.2 | Ex. |
| | atom % | 0.32 | 0.81 | 100 | | | | | |
| Experimental Ex. 7 | mass % | 0.30 | 1.10 | 100 | 0.32 | 1.7 | 12.1 | 17.3 | Comp. |
| | atom % | 0.32 | 0.81 | 100 | | | | | Ex. |
| Experimental Ex. 8 | mass % | 0.30 | 0.95 | 100 | 0.22 | 1.7 | 12.5 | 25.4 | Ex. |
| | atom % | 0.32 | 0.70 | 100 | | | | | |
| Experimental Ex. 9 | mass % | 0.30 | 0.95 | 100 | 0.22 | 1.7 | 12.4 | 25.9 | Ex. |
| | atom % | 0.32 | 0.70 | 100 | | | | | |
| Experimental Ex. 10 | mass % | 0.30 | 0.95 | 100 | 0.24 | 1.7 | 12.5 | 25.5 | Ex. |
| | atom % | 0.32 | 0.70 | 100 | | | | | |

Table 1 shows results of composition analysis with respect to the R-T-B based sintered magnets of Experimental Examples 1 to 10. In the contents of each element shown in Table 1, the contents of Nd, Pr, Dy, Tb, Fe, Co, Ga, Al, Cu, and Zr were measured by a fluorescent X-ray analysis, the content of B was measured by an ICP emission analysis, and the content of C was measured by a combustion in an oxygen airflow-infrared absorption method. [C]/([B]+[C]) was calculated by converting the contents of each element by mass % obtained by these methods into contents by atom %. T.RE in Tables is a summation of the contents of Nd, Pr, Dy, and Tb and is a total content of the rare earth elements in the sintered magnet.

The R-T-B based sintered magnets obtained in Experimental Examples 1 to 10 were evaluated in terms of an average grain size of the main phase grains. The average grain size of the main phase grains was calculated by a grain size distribution obtained by observing a polished cross section of a sample using a scanning electron microscope and capturing this observation data into an image analysis software.

A B-H tracer was used to measure magnetic properties of the R-T-B based sintered magnets obtained in Experimental Examples 1 to 10. Residual magnetic flux density Br and coercivity HcJ were measured as the magnetic properties. These results are also shown in Table 1.

Judging from the calculated values of [C]/([B]+[C]), the contents of each element, and the values of the average grain size of the main phase grains, the R-T-B based sintered magnets of Experimental Examples 3 to 6 and 8 to 10 correspond to Examples as they satisfy the conditions of the present invention, and the other R-T-B based sintered magnets correspond to Comparative Examples as they fail to satisfy the conditions of the present invention.

As shown in Table 1, the R-T-B based sintered magnets corresponding to Examples have higher magnetic properties than those of the R-T-B based sintered magnets corresponding to Comparative Examples. It was confirmed that a high coercivity of 21 kOe or higher was obtained in the range of $0.14 \leq [C]/([B]+[C]) \leq 0.30$. A higher coercivity of 25 kOe or higher was obtained when R is partially substituted with Dy, Tb etc.

Experimental Examples 11 to 16

Raw materials were blended so that R-T-B based sintered magnets having changed T.RE contents shown in Table 2 were obtained, and casting of a raw material alloy, a hydrogen pulverization treatment, a fine pulverization, and mixing of carbon black were carried out in the same manner as Experimental Examples 1 to 10 with respect to each composition. In the present Experimental Examples, the particle size of the finely pulverized powder was adjusted during fine pulverization so that main phase grains of the R-T-B based sintered magnet had an average grain size of 2.0 μm.

Thereafter, pressing, sintering, and an aging treatment were carried out in the same manner as Experimental Examples 1 to 10 to obtain respective R-T-B based sintered magnets of Experimental Examples 11 to 16.

Measurement of the contents of each element, evaluation of the average grain size of the main phase grains, and further measurement of magnetic properties with respect to the R-T-B based sintered magnets of Experimental Examples 11 to 16 were carried out in the same manner as Experimental Examples 1 to 10. The results are shown in Table 2.

TABLE 2

| | | Sintered magnet composition | | | | | | | | | | |
|---|---|---|---|---|---|---|---|---|---|---|---|---|
| | | Nd | Pr | Dy | Tb | TRE | Fe | Co | B | C | Ga | Al |
| Experimental | mass % | 26.0 | 6.0 | 0.0 | 0.0 | 32.0 | 64.2 | 0.80 | 0.75 | 0.21 | 0.70 | 0.15 |
| Ex. 11 | atom % | 12.0 | 2.8 | 0.0 | 0.0 | 14.8 | 76.5 | 0.90 | 4.61 | 1.16 | 0.67 | 0.37 |
| Experimental | mass % | 27.0 | 6.0 | 0.0 | 0.0 | 33.0 | 63.2 | 0.80 | 0.75 | 0.21 | 0.70 | 0.15 |
| Ex. 12 | atom % | 12.5 | 2.9 | 0.0 | 0.0 | 15.4 | 75.8 | 0.91 | 4.65 | 1.17 | 0.67 | 0.37 |
| Experimental | mass % | 28.0 | 6.0 | 0.0 | 0.0 | 34.0 | 62.2 | 0.80 | 0.75 | 0.21 | 0.70 | 0.15 |
| Ex. 13 | atom % | 13.1 | 2.9 | 0.0 | 0.0 | 16.0 | 75.2 | 0.92 | 4.68 | 1.18 | 0.68 | 0.38 |
| Experimental | mass % | 29.0 | 6.0 | 0.0 | 0.0 | 35.0 | 61.2 | 0.80 | 0.75 | 0.21 | 0.70 | 0.15 |
| Ex. 14 | atom % | 13.7 | 2.9 | 0.0 | 0.0 | 16.6 | 74.5 | 0.92 | 4.72 | 1.19 | 0.68 | 0.38 |
| Experimental | mass % | 30.0 | 6.0 | 0.0 | 0.0 | 36.0 | 60.2 | 0.80 | 0.75 | 0.21 | 0.70 | 0.15 |
| Ex. 15 | atom % | 14.3 | 2.9 | 0.0 | 0.0 | 17.2 | 73.8 | 0.93 | 4.75 | 1.20 | 0.69 | 0.38 |
| Experimental | mass % | 31.0 | 6.0 | 0.0 | 0.0 | 37.0 | 59.2 | 0.80 | 0.75 | 0.21 | 0.70 | 0.15 |
| Ex. 16 | atom % | 14.8 | 2.9 | 0.0 | 0.0 | 17.8 | 73.2 | 0.94 | 4.79 | 1.21 | 0.69 | 0.38 |

| | | Sintered magnet composition | | | | Average grain size | Br | Hcj | |
|---|---|---|---|---|---|---|---|---|---|
| | | Cu | Zr | total | [C]/([B] + [C]) | (μm) | kG | kOe | |
| Experimental | mass % | 0.40 | 0.80 | 100 | 0.20 | 2.0 | 13.8 | 22.1 | Ex. |
| Ex. 11 | atom % | 0.42 | 0.58 | 100 | | | | | |
| Experimental | mass % | 0.40 | 0.80 | 100 | 0.20 | 2.0 | 13.3 | 23.4 | Ex. |
| Ex. 12 | atom % | 0.42 | 0.59 | 100 | | | | | |
| Experimental | mass % | 0.40 | 0.80 | 100 | 0.20 | 2.0 | 12.9 | 23.7 | Ex. |
| Ex. 13 | atom % | 0.42 | 0.59 | 100 | | | | | |
| Experimental | mass % | 0.40 | 0.80 | 100 | 0.20 | 2.1 | 12.5 | 24.1 | Ex. |
| Ex. 14 | atom % | 0.43 | 0.60 | 100 | | | | | |
| Experimental | mass % | 0.40 | 0.80 | 100 | 0.20 | 2.2 | 11.9 | 24.3 | Ex. |
| Ex. 15 | atom % | 0.43 | 0.60 | 100 | | | | | |
| Experimental | mass % | 0.40 | 0.80 | 100 | 0.20 | 2.9 | 11.3 | 16.9 | Comp. |
| Ex. 16 | atom % | 0.43 | 0.61 | 100 | | | | | Ex. |

Judging from the calculated values of [C]/([B]+[C]), the contents of each element, and the values of the average grain size of the main phase grains, the R-T-B based sintered magnets of Experimental Examples 11 to 15 correspond to Examples as they satisfy the conditions of the present invention, and the R-T-B based sintered magnet of Experimental Example 16 corresponds to Comparative Example as it fails to satisfy the conditions of the present invention.

As shown in Table 2, a high coercivity of 21 kOe or higher was obtained when the T.RE content was in the range of 32 mass % or more and 36 mass % or less, and a particularly high coercivity was obtained when the T.RE content was in the range of 33 mass % or more and 36 mass % or less. On the other hand, coercivity was found to decrease due to grain growth during sintering when the T.RE content was 37 mass %.

Experimental Examples 17 to 22

Raw materials were blended so that R-T-B based sintered magnets having changed Ga contents shown in Table 3 were obtained, and casting of a raw material alloy, a hydrogen pulverization treatment, a fine pulverization, and mixing of carbon black were carried out in the same manner as Experimental Examples 1 to 10 with respect to each composition. In the present Experimental Examples, the particle size of the finely pulverized powder was adjusted during fine pulverization so that main phase grains of the R-T-B based sintered magnet had an average grain size of 1.3 μm.

Thereafter, pressing, sintering, and an aging treatment were carried out in the same manner as Experimental Examples 1 to 10 to obtain respective R-T-B based sintered magnets of Experimental Examples 17 to 22.

Measurement of the contents of each element, evaluation of the average grain size of the main phase grains, and further measurement of magnetic properties with respect to the R-T-B based sintered magnets of Experimental Examples 17 to 22 were carried out in the same manner as Experimental Examples 1 to 10. The results are shown in Table 3.

TABLE 3

| | | Sintered magnet composition | | | | | | | | | | |
|---|---|---|---|---|---|---|---|---|---|---|---|---|
| | | Nd | Pr | Dy | Tb | TRE | Fe | Co | B | C | Ga | Al |
| Experimental | mass % | 28.0 | 6.0 | 0.0 | 0.0 | 34.0 | 62.0 | 1.00 | 0.78 | 0.25 | 0.20 | 0.30 |
| Ex. 17 | atom % | 13.0 | 2.9 | 0.0 | 0.0 | 15.9 | 74.6 | 1.14 | 4.85 | 1.40 | 0.19 | 0.75 |
| Experimental | mass % | 28.0 | 6.0 | 0.0 | 0.0 | 34.0 | 61.8 | 1.00 | 0.78 | 0.25 | 0.40 | 0.30 |
| Ex. 18 | atom % | 13.1 | 2.9 | 0.0 | 0.0 | 15.9 | 74.4 | 1.14 | 4.85 | 1.40 | 0.39 | 0.75 |
| Experimental | mass % | 28.0 | 6.0 | 0.0 | 0.0 | 34.0 | 61.6 | 1.00 | 0.78 | 0.25 | 0.60 | 0.30 |
| Ex. 19 | atom % | 13.1 | 2.9 | 0.0 | 0.0 | 15.9 | 74.2 | 1.14 | 4.85 | 1.40 | 0.58 | 0.75 |
| Experimental | mass % | 28.0 | 6.0 | 0.0 | 0.0 | 34.0 | 61.2 | 1.00 | 0.78 | 0.25 | 1.00 | 0.30 |
| Ex. 20 | atom % | 13.1 | 2.9 | 0.0 | 0.0 | 15.9 | 73.8 | 1.14 | 4.86 | 1.40 | 0.97 | 0.75 |
| Experimental | mass % | 28.0 | 6.0 | 0.0 | 0.0 | 34.0 | 60.8 | 1.00 | 0.78 | 0.25 | 1.40 | 0.30 |
| Ex. 21 | atom % | 13.1 | 2.9 | 0.0 | 0.0 | 16.0 | 73.4 | 1.14 | 4.86 | 1.40 | 1.35 | 0.75 |

TABLE 3-continued

| | | | | | | | | | | | | |
|---|---|---|---|---|---|---|---|---|---|---|---|---|
| Experimental Ex. 22 | mass % | 28.0 | 6.0 | 0.0 | 0.0 | 34.0 | 60.4 | 1.00 | 0.78 | 0.25 | 1.80 | 0.30 |
| | atom % | 13.1 | 2.9 | 0.0 | 0.0 | 16.0 | 73.0 | 1.14 | 4.87 | 1.40 | 1.74 | 0.75 |

| | | Sintered magnet composition | | | | Average grain size | Br | Hcj | |
|---|---|---|---|---|---|---|---|---|---|
| | | Cu | Zr | total | [C]/([B] + [C]) | (μm) | kG | kOe | |
| Experimental Ex. 17 | mass % | 0.20 | 1.25 | 100 | 0.22 | 1.3 | 12.8 | 19.4 | Comp. |
| | atom % | 0.21 | 0.92 | 100 | | | | | Ex. |
| Experimental Ex. 18 | mass % | 0.20 | 1.25 | 100 | 0.22 | 1.3 | 12.5 | 22.6 | Ex. |
| | atom % | 0.21 | 0.92 | 100 | | | | | |
| Experimental Ex. 19 | mass % | 0.20 | 1.25 | 100 | 0.22 | 1.3 | 12.5 | 24.6 | Ex. |
| | atom % | 0.21 | 0.92 | 100 | | | | | |
| Experimental Ex. 20 | mass % | 0.20 | 1.25 | 100 | 0.22 | 1.3 | 12.4 | 24.7 | Ex. |
| | atom % | 0.21 | 0.92 | 100 | | | | | |
| Experimental Ex. 21 | mass % | 0.20 | 1.25 | 100 | 0.22 | 1.3 | 12.1 | 25.0 | Ex. |
| | atom % | 0.21 | 0.92 | 100 | | | | | |
| Experimental Ex. 22 | mass % | 0.20 | 1.25 | 100 | 0.22 | 1.3 | 11.3 | 25.0 | Ex. |
| | atom % | 0.21 | 0.92 | 100 | | | | | |

Judging from the calculated values of [C]/([B]+[C]), the contents of each element, and the values of the average grain size of the main phase grains, the R-T-B based sintered magnets of Experimental Examples 18 to 22 correspond to Examples as they satisfy the conditions of the present invention, and the R-T-B based sintered magnet of Experimental Example 17 corresponds to Comparative Example as it fails to satisfy the conditions of the present invention. A high coercivity of 22 kOe or higher was obtained when the Ga content was 0.4 mass % or more. A particularly high coercivity was obtained when the Ga content was 0.6 mass % or more. Residual magnetic flux density, however, tends to decrease when the Ga content was 1.4 mass % or more.

Experimental Examples 23 to 27

Raw materials were blended so that R-T-B based sintered magnets having the same composition as Experimental Example 5 shown in Table 4 were obtained, and casting of a raw material alloy, a hydrogen pulverization treatment, a fine pulverization, and mixing of carbon black were carried out in the same manner as Experimental Examples 1 to 10. In the present Experimental Examples, a classification condition of a jet mill was adjusted during fine pulverization to obtain different average grain sizes of main phase grains in the R-T-B based sintered magnets. Incidentally, although not shown in Table 4, a classification condition of a jet mill where main phase grains of the R-T-B based sintered magnet had an average grain size of 0.8 μm or less was also attempted, but the finely pulverized powder obtained by collection had an extremely small weight and was not worth being evaluated.

Thereafter, pressing, sintering, and an aging treatment were carried out in the same manner as Experimental Examples 1 to 10 to obtain respective R-T-B based sintered magnets of Experimental Examples 23 to 27.

Measurement of the contents of each element, evaluation of the average grain size of the main phase grains, and further measurement of magnetic properties with respect to the R-T-B based sintered magnets of Experimental Examples 23 to 27 were carried out in the same manner as Experimental Examples 1 to 10. The results are shown in Table 4.

TABLE 4

| | | Sintered magnet composition | | | | | | | | | | |
|---|---|---|---|---|---|---|---|---|---|---|---|---|
| | | Nd | Pr | Dy | Tb | TRE | Fe | Co | B | C | Ga | Al |
| Experimental Ex. 23 | mass % | 27.7 | 6.3 | 0.0 | 0.0 | 34.0 | 61.6 | 0.68 | 0.71 | 0.34 | 0.78 | 0.19 |
| | atom % | 12.9 | 3.0 | 0.0 | 0.0 | 16.0 | 74.3 | 0.78 | 4.43 | 1.91 | 0.75 | 0.47 |
| Experimental Ex. 24 | mass % | 27.3 | 6.1 | 0.0 | 0.0 | 33.4 | 62.1 | 0.69 | 0.72 | 0.34 | 0.80 | 0.20 |
| | atom % | 12.7 | 2.9 | 0.0 | 0.0 | 15.6 | 74.6 | 0.79 | 4.47 | 1.90 | 0.77 | 0.50 |
| Experimental Ex. 25 | mass % | 27.1 | 6.0 | 0.0 | 0.0 | 33.1 | 62.4 | 0.70 | 0.73 | 0.34 | 0.80 | 0.20 |
| | atom % | 12.6 | 2.8 | 0.0 | 0.0 | 15.4 | 74.8 | 0.79 | 4.52 | 1.89 | 0.77 | 0.50 |
| Experimental Ex. 26 | mass % | 27.0 | 6.0 | 0.0 | 0.0 | 33.0 | 62.5 | 0.70 | 0.73 | 0.34 | 0.80 | 0.20 |
| | atom % | 12.5 | 2.8 | 0.0 | 0.0 | 15.4 | 74.8 | 0.79 | 4.51 | 1.89 | 0.77 | 0.50 |
| Experimental Ex. 27 | mass % | 27.0 | 6.0 | 0.0 | 0.0 | 33.0 | 62.5 | 0.70 | 0.73 | 0.34 | 0.80 | 0.20 |
| | atom % | 12.5 | 2.8 | 0.0 | 0.0 | 15.4 | 74.8 | 0.79 | 4.51 | 1.89 | 0.77 | 0.50 |

| | | Sintered magnet composition | | | | Average grain size | Br | Hcj | |
|---|---|---|---|---|---|---|---|---|---|
| | | Cu | Zr | total | [C]/([B] + [C]) | (μm) | kG | kOe | |
| Experimental Ex. 23 | mass % | 0.29 | 1.42 | 100 | 0.30 | 0.8 | 12.3 | 24.5 | Ex. |
| | atom % | 0.31 | 1.05 | 100 | | | | | |
| Experimental Ex. 24 | mass % | 0.30 | 1.41 | 100 | 0.30 | 1.3 | 12.8 | 24.3 | Ex. |
| | atom % | 0.32 | 1.04 | 100 | | | | | |

TABLE 4-continued

| | | | | | | | | | |
|---|---|---|---|---|---|---|---|---|---|
| Experimental Ex. 25 | mass % | 0.30 | 1.40 | 100 | 0.30 | 2.0 | 13.0 | 23.3 | Ex. |
| | atom % | 0.32 | 1.03 | 100 | | | | | |
| Experimental Ex. 26 | mass % | 0.30 | 1.40 | 100 | 0.30 | 2.8 | 13.1 | 21.9 | Ex. |
| | atom % | 0.32 | 1.03 | 100 | | | | | |
| Experimental Ex. 27 | mass % | 0.30 | 1.40 | 100 | 0.30 | 4.2 | 13.2 | 18.8 | Comp. Ex. |
| | atom % | 0.32 | 1.03 | 100 | | | | | |

Judging from the values of the average grain size of the main phase grains, the R-T-B based sintered magnets of Experimental Examples 23 to 26 correspond to Examples as they satisfy the conditions of the present invention, and the R-T-B based sintered magnet of Experimental Example 27 corresponds to Comparative Example as it fails to satisfy the conditions of the present invention. A high coercivity of 20 kOe or higher was obtained when the average grain size of the main phase grains was 2.8 μm or less. On the other hand, coercivity tends to decrease when the average grain size of the main phase grains was more than 2.8 μm.

Experimental Examples 28 to 35

Raw materials were blended so that R-T-B based sintered magnets having changed Zr contents shown in Table 5 were obtained, and casting of a raw material alloy, a hydrogen pulverization treatment, a fine pulverization, and mixing of carbon black were carried out in the same manner as Experimental Examples 1 to 10. During fine pulverization, a classification condition of a jet mill was adjusted so that main phase grains of the R-T-B based sintered magnet had an average grain size of 1.2 μm in Experimental Examples 28 to 31, and a classification condition of a jet mill was adjusted so that main phase grains of the R-T-B based sintered magnet had an average grain size of 2.3 μm in Experimental Examples 32 to 35.

Thereafter, pressing, sintering, and an aging treatment were carried out in the same manner as Experimental Examples 1 to 10 to obtain respective R-T-B based sintered magnets of Experimental Examples 41 to 48.

Measurement of the contents of each element, evaluation of the average grain size of the main phase grains, and further measurement of magnetic properties with respect to the R-T-B based sintered magnets of Experimental Examples 28 to 35 were carried out in the same manner as Experimental Examples 1 to 10. The results are shown in Table 5.

TABLE 5

| | | Sintered magnet composition | | | | | | | | | | | |
|---|---|---|---|---|---|---|---|---|---|---|---|---|---|
| | | Nd | Pr | Dy | Tb | TRE | Fe | Co | B | C | Ga | Al | Cu |
| Experimental Ex. 28 | mass % | 34.0 | 0.0 | 0.0 | 0.0 | 34.0 | 60.5 | 1.50 | 0.77 | 0.28 | 0.70 | 0.10 | 0.40 |
| | atom % | 15.9 | 0.0 | 0.0 | 0.0 | 15.9 | 73.2 | 1.72 | 4.82 | 1.58 | 0.68 | 0.25 | 0.43 |
| Experimental Ex. 29 | mass % | 34.0 | 0.0 | 0.0 | 0.0 | 34.0 | 60.7 | 1.50 | 0.77 | 0.28 | 0.70 | 0.10 | 0.40 |
| | atom % | 15.9 | 0.0 | 0.0 | 0.0 | 15.9 | 73.4 | 1.72 | 4.81 | 1.58 | 0.68 | 0.25 | 0.43 |
| Experimental Ex. 30 | mass % | 34.0 | 0.0 | 0.0 | 0.0 | 34.0 | 60.9 | 1.50 | 0.77 | 0.28 | 0.70 | 0.10 | 0.40 |
| | atom % | 15.9 | 0.0 | 0.0 | 0.0 | 15.9 | 73.6 | 1.72 | 4.81 | 1.57 | 0.68 | 0.25 | 0.43 |
| Experimental Ex. 31 | mass % | 34.0 | 0.0 | 0.0 | 0.0 | 34.0 | 61.1 | 1.50 | 0.77 | 0.28 | 0.70 | 0.10 | 0.40 |
| | atom % | 15.9 | 0.0 | 0.0 | 0.0 | 15.9 | 73.8 | 1.72 | 4.81 | 1.57 | 0.68 | 0.25 | 0.42 |
| Experimental Ex. 32 | mass % | 33.5 | 0.0 | 0.0 | 0.0 | 33.5 | 62.6 | 1.00 | 0.79 | 0.16 | 0.50 | 0.30 | 0.20 |
| | atom % | 15.6 | 0.0 | 0.0 | 0.0 | 15.6 | 75.3 | 1.14 | 4.91 | 0.90 | 0.48 | 0.75 | 0.21 |
| Experimental Ex. 33 | mass % | 33.5 | 0.0 | 0.0 | 0.0 | 33.5 | 62.8 | 1.00 | 0.79 | 0.16 | 0.50 | 0.30 | 0.20 |
| | atom % | 15.6 | 0.0 | 0.0 | 0.0 | 15.6 | 75.4 | 1.14 | 4.91 | 0.89 | 0.48 | 0.75 | 0.21 |
| Experimental Ex. 34 | mass % | 33.5 | 0.0 | 0.0 | 0.0 | 33.5 | 63.0 | 1.00 | 0.79 | 0.16 | 0.50 | 0.30 | 0.20 |
| | atom % | 15.6 | 0.0 | 0.0 | 0.0 | 15.6 | 75.6 | 1.14 | 4.90 | 0.89 | 0.48 | 0.75 | 0.21 |
| Experimental Ex. 35 | mass % | 33.5 | 0.0 | 0.0 | 0.0 | 33.5 | 63.2 | 1.00 | 0.79 | 0.16 | 0.50 | 0.30 | 0.20 |
| | atom % | 15.6 | 0.0 | 0.0 | 0.0 | 15.6 | 75.8 | 1.14 | 4.90 | 0.89 | 0.48 | 0.75 | 0.21 |

| | | Sintered magnet composition | | | | Average grain size | Br | Hcj | |
|---|---|---|---|---|---|---|---|---|---|
| | | Zr | total | [C]/([B] + [C]) | [B] + [C] − [Zr] | (μm) | kG | kOe | |
| Experimental Ex. 28 | mass % | 1.80 | 100 | 0.25 | 5.1 | 1.2 | 12.3 | 23.5 | Ex. |
| | atom % | 1.34 | 100 | | | | | | |
| Experimental Ex. 29 | mass % | 1.60 | 100 | 0.25 | 5.2 | 1.2 | 12.4 | 24.7 | Ex. |
| | atom % | 1.19 | 100 | | | | | | |
| Experimental Ex. 30 | mass % | 1.40 | 100 | 0.25 | 5.3 | 1.2 | 12.5 | 24.8 | Ex. |
| | atom % | 1.04 | 100 | | | | | | |
| Experimental Ex. 31 | mass % | 1.20 | 100 | 0.25 | 5.5 | 1.3 | 12.6 | 23.6 | Ex. |
| | atom % | 0.89 | 100 | | | | | | |
| Experimental Ex. 32 | mass % | 1.00 | 100 | 0.15 | 5.1 | 2.3 | 13.3 | 21.6 | Ex. |
| | atom % | 0.74 | 100 | | | | | | |
| Experimental Ex. 33 | mass % | 0.80 | 100 | 0.15 | 5.2 | 2.3 | 13.4 | 22.9 | Ex. |
| | atom % | 0.59 | 100 | | | | | | |
| Experimental Ex. 34 | mass % | 0.60 | 100 | 0.15 | 5.4 | 2.3 | 13.5 | 22.7 | Ex. |
| | atom % | 0.44 | 100 | | | | | | |
| Experimental Ex. 35 | mass % | 0.40 | 100 | 0.15 | 5.5 | 2.3 | 13.6 | 21.4 | Ex. |
| | atom % | 0.29 | 100 | | | | | | |

Judging from the calculated values of [C]/([B]+[C]), the contents of each element, and the values of the average grain size of the main phase grains, the R-T-B based sintered magnets of Experimental Examples 28 to 35 correspond to Examples as they satisfy the conditions of the present invention. Coercivity changed when a Zr content was different even if a value of [C]/([B]+[C]) was the same. A higher coercivity was obtained in the range of 5.2≤[B]+[C]−[Zr]≤5.4.

NUMERICAL REFERENCES

4 main phase grain
6 grain boundary
100 R-T-B based sintered magnet

The invention claimed is:

1. An R-T-B based permanent magnet comprising main phase grains composed of $R_2T_{14}B$ compound, wherein R is a rare earth element, T is iron group element(s) comprising Fe or Fe and Co, and B is boron, an average grain size of the main phase grains is 1.3 μm or more and 2.8 μm or less, the R-T-B based permanent magnet contains at least Zr, C and Ga, and optionally contains Cu, Al, 0, N, Ti, V, Cr, Mn, Ni, Nb, Mo, Hf, Ta, W, Si, Bi, and Sn in addition to R, T, and B, R is contained at 29.5 mass % or more and 37 mass % or less, B is contained at 0.71 mass % or more and 0.86 mass % or less, C is contained at 0.13 mass % or more and 0.34 mass % or less, Ga is contained at 0.40 mass % or more and 1.80 mass % or less, Zr is contained at 0.4 mass % or more and 2.5 mass % or less, Cu is contained at 1.5 mass % or less (including zero mass %), Al is contained at 0.6 mass % or less (including zero mass %), O is contained at 0.5 mass % or less (including zero mass %), N is contained at 0.2 mass or less (including zero mass %), a heavy rare earth element is not substantially contained, a total content of Ti, V, Cr, Mn, Ni, Nb, Mo, Hf, Ta, W, Si, Bi, and Sn are 2.0 mass % or less (including zero mass %), T is contained a balance, a formula (1) of 0.14≤[C]/([B]+[C])≤0.30 is satisfied, where [B] is a B content represented by atom %, and [C] is a C content represented by atom %, and a formula (2) of 5.2≤[B]+[C]−[Zr]≤5.4 is satisfied, where [B] is a B content represented by atom %, [C] is a C content represented by atom %, and [Zr] is a Zr content represented by atom %, and coercivity HcJ of the R-T-B based permanent magnet is 21.9 kOe or more.

2. The R-T-B based permanent magnet according to claim 1, wherein

Zr is contained at 0.4 mass % or more and 1.8 mass % or less.

3. The R-T-B based permanent magnet according to claim 1, further comprising at least Al, wherein Al is contained at 0.03 mass % or more and 0.6 mass % or less.

4. The R-T-B based permanent magnet according to claim 1, wherein

Co is contained at 0.3 mass % or more and 4.0 mass % or less.

5. The R-T-B based permanent magnet according to claim 1, further comprising at least Cu, wherein Cu is contained at 0.05 mass % or more and 1.5 mass % or less.

6. The R-T-B based permanent magnet according to claim 1, wherein

C is contained at 0.15 mass % or more and 0.34 mass % or less.

7. The R-T-B based permanent magnet according to claim 1, wherein

C is contained at 0.15 mass % or more and 0.30 mass % or less.

8. The R-T-B based permanent magnet according to claim 1, wherein

B is contained at 0.71 mass % or more and 0.81 mass % or less.

9. The R-T-B based permanent magnet according to claim 1, wherein

Ga is contained at 0.40 mass % or more and 1.40 mass % or less.

10. The R-T-B based permanent magnet according to claim 1, wherein the average grain size of the main phase grains is 1.7 μm or more and 2.8 μm or less.

11. The R-T-B based permanent magnet according to claim 1, wherein the average grain size of the main phase grains is 2.0 μm or more and 2.8 μm or less.

12. The R-T-B based permanent magnet according to claim 1, which as a residual magnetic flux density Br of 13.0 kG or more.

13. The R-T-B based permanent magnet according to claim 1, wherein Ga is contained at 0.60 mass % or more and 1.40 mass % or less.

14. The R-T-B based permanent magnet according to claim 1, which has a residual magnetic flux density Br of 12.4 kG or more.

15. The R-T-B based permanent magnet according to claim 1, which has a residual magnetic flux density Br of 11.3 kG or more and 13.8 kG or less.

16. The R-T-B based permanent magnet according to claim 1, which has a coercivity HcJ of 25.0 kOe or less.

* * * * *